United States Patent [19]

Liedtke

[11] 4,192,325

[45] Mar. 11, 1980

[54] HAIR STYLING APPLIANCE INCLUDING IMPROVED BAYONET FASTENERS FOR ASSEMBLING SAME

[75] Inventor: Ronald R. Liedtke, Addison, Ill.

[73] Assignee: Schick Incorporated, Lancaster, Pa.

[21] Appl. No.: 868,403

[22] Filed: Jan. 10, 1978

[51] Int. Cl.[2] ..... A45D 20/00

[52] U.S. Cl. ..... 132/9

[58] Field of Search ..... 132/9; 34/97

[56] References Cited

U.S. PATENT DOCUMENTS

| | | | |
|---|---|---|---|
| 2,678,376 | 5/1954 | Lockwood | 34/97 X |
| 3,322,144 | 5/1967 | Boer, Jr. et al. | 132/9 X |
| 3,868,495 | 2/1975 | Dyer | 132/112 |
| 3,890,985 | 6/1975 | Hicks | 132/9 |
| 3,903,905 | 9/1975 | Tucker | 132/9 |
| 4,040,432 | 8/1977 | Adinolfi | 132/9 |

*Primary Examiner*—G. E. McNeill

*Attorney, Agent, or Firm*—Lockwood, Dewey, Alex & Cummings

[57] ABSTRACT

A compact light-weight axial-flow type hair styling appliance incorporates improved bayonet mountings between respective body housing portions of the styler, and between the air outlet port of the styler and styling attachments which are removably affixable thereto. The styler-housing bayonet mounting includes a resilient arm extending from one of the bayonet mounting members which biases the mating bayonet mounting member in a rattle-free engagment. Additional detent-indent engagement between the respective bayonet mounting members locks the styling attachment in place on the styler housing until removal of same is accomplished by a quick twist in either direction of the attachment mounted to the housing.

12 Claims, 8 Drawing Figures

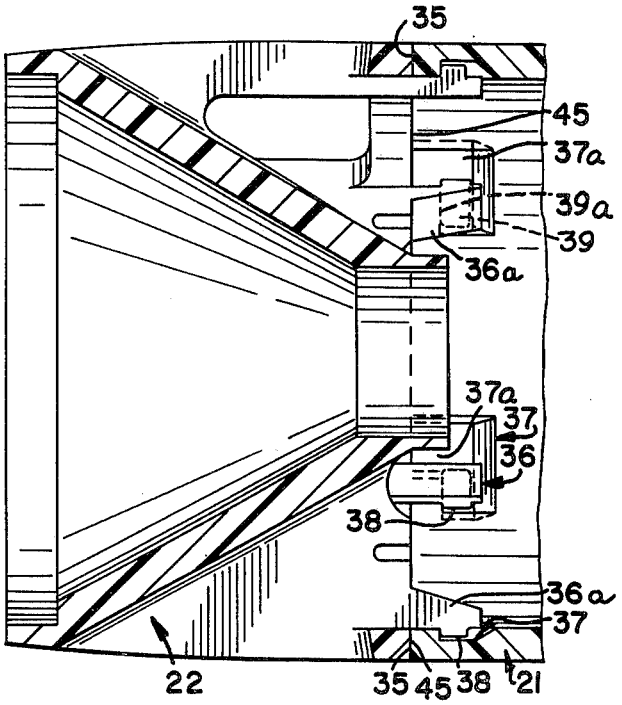
FIG. 8
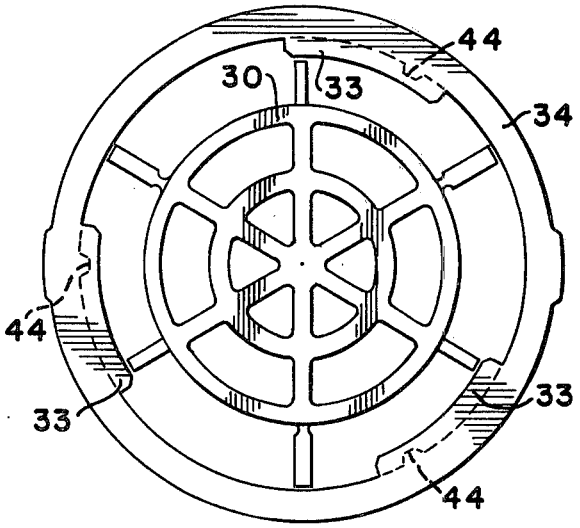
FIG. 7
FIG. 6
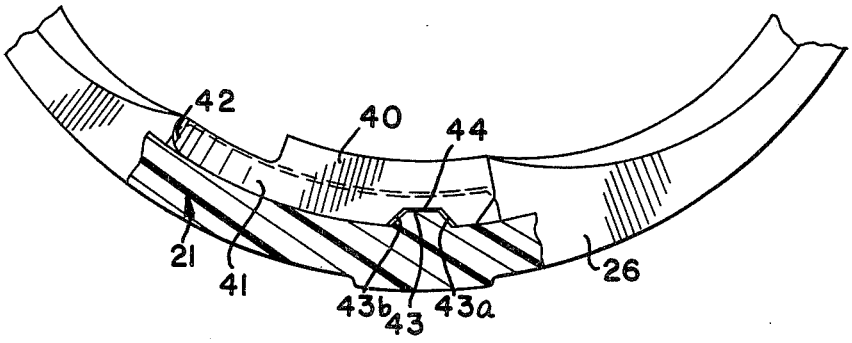

HAIR STYLING APPLIANCE INCLUDING IMPROVED BAYONET FASTENERS FOR ASSEMBLING SAME

BACKGROUND OF THE INVENTION

This application relates to hand-held styling appliances. More particularly, the present application relates to bayonet fasteners for providing improved assembly of hand-held hair styling appliances, including the removable attachment of combs and brushes to the appliance.

Heretofore, appliances for drying and styling human hair have generally included an air blower and a heater assembly positioned downstream thereof which, when combined, direct a hot air stream to the user's hair. Additionally, in hair styling and drying appliances which are adapted to be hand-held, a comb, brush, or other hair manipulation device is conventionally added to the appliance to aid in styling a user's hair while drying same. Originally, conventional hand-held dryers utilized radial flow fans therein. These hair dryers, usually including metal bodies, were heavy, cumbersome, and expensive to the point where their use was largely limited to professional hairdressers.

More recently, the use of transverse flow fans in hair dryers and stylers together with molded plastic bodies for same have allowed such appliances to be made relatively inexpensively, thus bringing the hand-held hair styler into fairly widespread consumer use. In transverse flow hair stylers, the air flow is directed across the fan blades generally perpendicular to the axis of fan rotation. In this type of hair styler, rather complex shaped molded plastic bodies have been utilized. The fasteners utilized to assemble the body parts have included screws together with molded screw receiving posts, numerous molded indent-detent type fasteners positioned around the parting line of the molded pieces, and other types of snap fasteners and the like. With the transverse fan appliance, a handle portion of the body is conventionally positioned to extend along the axis of the fan away from the general direction of air flow through the fan. Also, appliances utilizing transverse flow fans conventionally have an elongate rectangular air outlet duct for which special combs and brushes have been developed. These combs and brushes are generally equipped with molded snap fasteners for retention in mounted position on the outlet duct, or they have also been slidably retained in tongue and groove relation on the outlet duct.

The latest type of hand-held hair styler has incorporated the use of an axial flow fan therein. The use of axial flow fans in such appliances allows the fan, motor, and heating element to be positioned in a generally circular cross-sectioned tubular body. The body may enclose the fan, motor, and heating element much as a nacelle encloses the fan blades and motor of a jet aircraft engine. The use of a generally tubular appliance body also allows the elimination of a heretofore conventional handle, as a user's hand can conveniently grasp the tubular body of the appliance.

Additionally, with the use of tubular appliance body portions, conventionally made of high impact heat resistant plastic, the rather complex indent-detent fasteners, snap-on retainers, and other types of fasteners utilized for assembling the relatively complex curved body panels of transverse flow fans is eliminated.

Therefore, a need has arisen for providing a simplified and improved fastener for easing the assembly of the molded body panels of a hand-held hair styling appliance.

Further, a need has arisen for providing improved and simplified fasteners for removably attaching combs, brushes and the like to a hand-held hair styling appliance.

Accordingly, it is a general object of the present invention to provide improved means for fastening together the body panels of a hand-held hair styling appliance.

A more specific object of the present invention is the provision in a hair styling appliance wherein an annular hot air output duct of the appliance and a comb or brush attached thereto for styling a user's hair include improved means for being removably fastened together.

Another object of the present invention is the provision of improved bayonet-type fasteners between substantially annular end surfaces of the body panels of a hand-held hair styling appliance.

SUMMARY OF THE INVENTION

The invention is directed in a hair styling appliance for applying a hot air stream to hair wherein the appliance is of the type including a housing with an annular air outlet port thereon and a styling attachment including an annular air inlet port thereon which is adapted for releasible mounting on the housing outlet port. The improvement comprises a plurality of matingly engageable first and second bayonet mounting members positioned in substantially equally spaced angular relation around the respective annular ports. Each of the first bayonet mounting members includes an elongate detent which extends radially inwardly of the inner circumference of one of the annular ports. Each of the second bayonet mounting members includes a base portion extending axially outwardly of the other annular port and a block portion which extends radially outwardly of the base portion. The distance between the block portion and the annular port on which the second bayonet mounting is positioned is approximately equal to the thickness of the first detent. The block portion further includes a resilient arm which extends outwardly thereof. The resilient arm is curved toward the plane of the annular port on which the second bayonet mounting is positioned. The engagement of the first and second bayonet members is accomplished by rotatingly inserting the elongate detent on one annular port into the second bayonet mounting on the other annular port. The resilient arm on the second mounting member biases against the elongate detent to provide a secure rattle-free engagement therebetween.

The invention is further directed in a hair styling appliance of the type including first and second housing portions, wherein each includes respective annular ports thereon adapted for releasible mating engagement with each other. The improvement comprises a plurality of bayonet mounting members and bayonet receiving indents positioned around the respective annular ports in substantially equally spaced relation. Each of the bayonet members includes a base portion which extends axially outwardly of the annular port on which it is positioned. A detent extends radially outwardly of each base portion outer surface. Each of the bayonet receiving indents is L-shape and is formed in the interior wall of one of the housing portions adjacent the annular port thereon. The assembly of the housing portions is accomplished by inserting the bayonet mounting members in the bayonet indents until the respective annular ports touch and then rotating one housing portion relative the other housing portion thus engaging the detents in the respective feet of the L-shape indents.

BRIEF DESCRIPTION OF THE DRAWINGS

The features of the present invention, which are believed to be novel, are set forth with particularity in the appended claims. The invention may best be understood from the following detailed description of a currently preferred embodiment thereof, taken in conjunction with the accompanying drawings, wherein:

FIG. 6 is an enlarged fragmentary view of one of the bayonet mountings shown in FIG. 4.

FIG. 7 is a cross-sectional view taken along line 7—7 of FIG. 2.

FIG. 8 is a cross-sectional view taken along line 8—8 of FIG. 1.

DETAILED DESCRIPTION OF THE PREFERRED EMBODIMENT

Figures 1, 2:
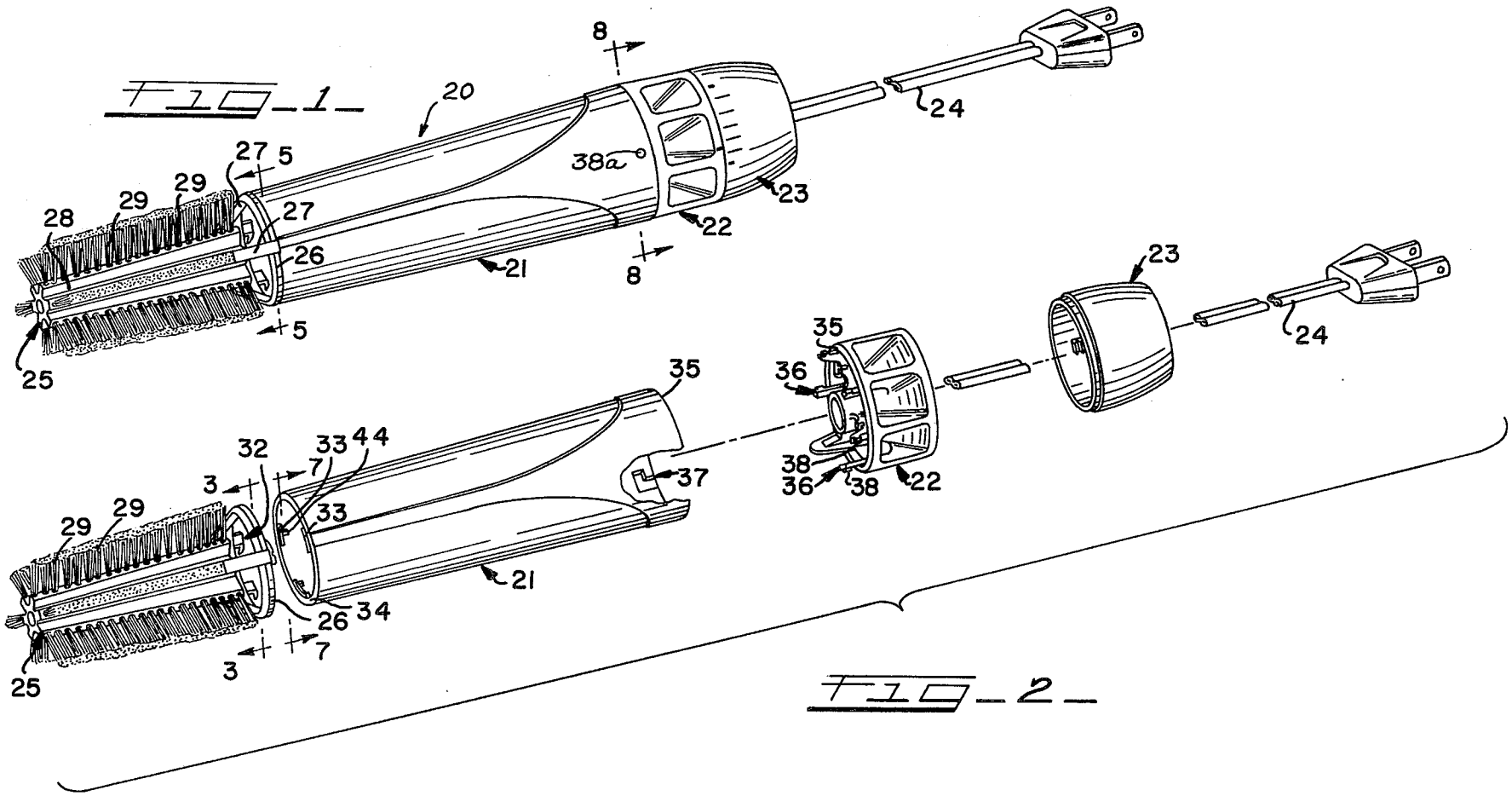
FIG. 1 is a perspective view of the hand-held hair styling appliance incorporating annular body panels and respective accessories thereto fastened together by the bayonet fasteners of the present invention.
FIG. 2 is a partially exploded perspective view of the body panels and brush accessory in the appliance of FIG. 1 showing the bayonet-type mountings of the present invention.

Referring to FIG. 1, the hand-held hair styling appliance of the present invention, generally indicated at 20, includes a tubular fan and heater assembly housing 21 together with an annular air inlet and switch housing 22 which is connected to housing 21 by a plurality of bayonet fasteners to be described below. The hair styling appliance 20 further includes an annular rotatably mounted switch knob 23 positioned axially adjacent housing 22 which, in this embodiment, is operatively attached to a six position switch mounted on the interior of the housing. The electrical cord 24, through which power for the appliance is obtained, extends axially outwardly of the appliance at the distal end of the switch knob 23. At the opposing end of the appliance, a removable brush 25, comb (not shown), or other attachment is fastened to the outlet end of the fan and heater housing 21 with the bayonet fastener of the invention. Brush 25 includes an annular mounting portion 26 which is connected by a plurality of bridging portions 27—27, to an axially extending brush mounting column 28. The central column 28 includes a plurality of bristles 29—29 extending radially therefrom in a plurality of axially aligned rows which are positioned in even angularly spaced relation around the column.

As shown most clearly in FIG. 2, the circular mounting portion 26 of brush 25 includes a plurality of axially extending bayonet-type arm members 32—32 forming one half of the first bayonet mounting of the invention. A plurality of radially inwardly extending detent portions 33—33 are positioned immediately adjacent the annular end surface 34 of the outlet duct for the fan and heater housing 21 and form the other half of the first bayonet mounting of the invention. The second bayonet-type mounting of the present invention fastens the annular air inlet housing 22 to the inlet end 35 of the fan and heater housing 21. The bayonet fastener on the inlet housing 22 includes a plurality of axially extending web portions 36—36, and each web portion includes a radially outwardly extending detent portion 38—38. Each detent portion 38 is adapted to be received in a L-shape indent 37, which is one of a plurality of such indented portions extending in even spaced relation around the interior surface of the fan and heater housing 21. Each indent portion 37 is positioned in communication with the inlet end of housing 21 such that the detent portions 38 may be positioned therein as the attachment is removably mounted on the appliance. The operation of the bayonet mounting will be discussed in greater detail below.

Figure 3:
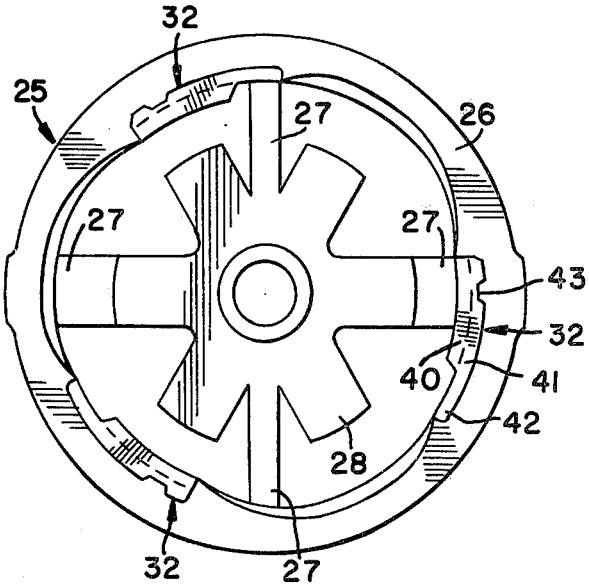
FIG. 3 is a cross-sectional view taken along line 3—3 of FIG. 2.
Figure 4:
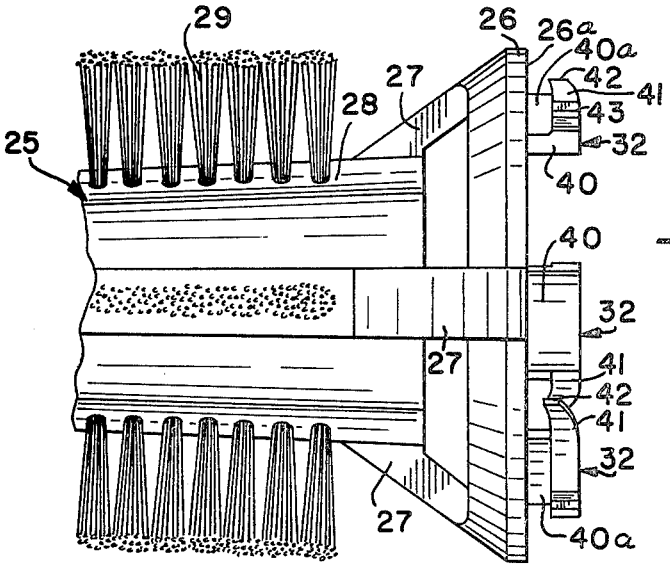
FIG. 4 is a fragmentary elevational view of a brush attachment for the hair styling appliance of FIG. 1.

Referring to FIGS. 3 and 4, the annular mounting portion 26 of the attachable brush 25, in this embodiment, includes three male bayonet arm members 32—32 constructed in accordance with the present invention which extend axially outwardly of the bottom surface 26*a* of mounting portion 26 in evenly spaced 120° angular relation to each other. Each bayonet arm member includes a base portion 40 which is curved to extend along the annular inner surface 26*a* of the brush mounting 26 across an angular segment thereof sufficient to provide adequate strength to the bayonet arm member. The radial thickness of base portion 40 is less than that of both the annular surface 26*a* and the remainder of the bayonet member for reasons to be discussed below.

A curved elongate arm 41 extends axially outwardly of the base 40 of the bayonet arm member 32. Curved arm 41 also extends angularly outwardly of base 40 to define a distal or trailing end 42. Aside from being curved angularly as is base portion 40, the distal end 42 is also curved toward mounting surface 26*a* of brush 25. The mounting surface 26*a* and the radially outwardmost surface of curved arm 41 which contacts surface 40*a*, combine to define a hollow area having opposed parallel surfaces into which one of the elongate detent portions 33 on housing 21 may be inserted. Additionally, the elongate arm portion 41 of bayonet arm member 32 has a trapezoidal shape indent portion 43 which is positioned thereon to extend radially inwardly of the outermost surface thereof. The trapezoidal indent portion 43 includes angularly oriented opposed surfaces 43*a*, 43*b* the function of which will be discussed below.

Figure 5:
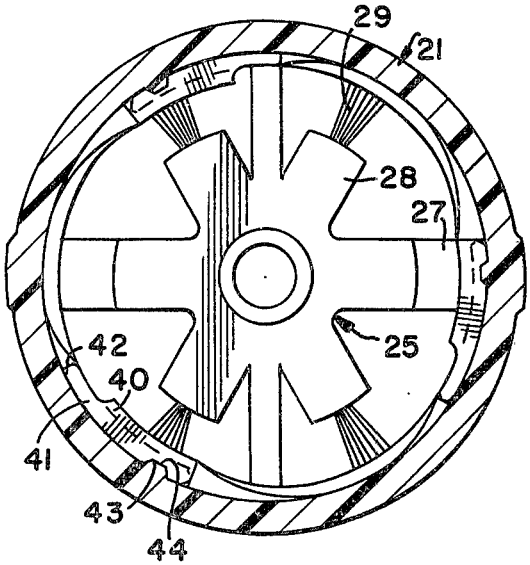
FIG. 5 is a cross-sectional view taken along line 5-5 of FIG. 1.

Referring to FIGS. 5, 6, and 7, the annular air outlet end of housing 21 includes, in this embodiment, three elongate detent portions 33—33 which extend radially inwardly of the inner annular edge on outlet duct end surface 34. The length of the angularly curved detent portions 33—33 approximate the length of the respective curved arms 41 (measured radially) on the bayonet arm member 32. Further, the thickness of elongate detent portions 33—33 defined by their opposed parallel side surfaces approximate the spatial distance between the mounting surface 26*a* of brush 25 and the elongate arm portions 41 of the bayonet arm members which allow the arm member to be snugly mounted thereover. Also, three trapezoidal detent portions 44—44 on housing 21 are each positioned axially inwardly adjacent one of the elongate detent portions 33—33 in an orientation identical to each detent portion 33. The dimensions of trapezoidal detent portions 44 are substantially similar to the dimensions of trapezoidal indent portion 43 positioned on the bayonet arm member 32. Also, the position of indent portion 43 along the length of curved arm 41 provides for the alignment of detent portion 44 in indent portion 43 and each bayonet arm member 32 is properly aligned over each elongate detent 33. The relation of the elongate detent portion and the trapezoidal detent portion 44 is clearly shown in FIG. 2.

In FIG. 7, a perforate shield 30 keeps a user's fingers away from the heating element therebehind while allowing heated air to pass therethrough. A foil heat shield (not shown) extends around the cylindrical inner surface of housing 21 to maintain the plastic housing at an ambient temperature.

In operation, the brush 25 or other attachment is removably affixed to the outlet end of the housing 21 by axially aligning the brush with the housing, then inserting the bayonet arm members into the outlet end of the housing 21 such that each bayonet member 32 is positioned in the angular space between adjacent elongate detent portions 33—33 thereon until the end surface 34 of housing 21 is contiguous with the bottom surface 26*a* of the annular mounting 26 on brush 25. When the brush 25 and housing 21 are thusly positioned, they are rotated relative one another, preferably with each detent 33 being inserted in the blunt end of the bayonet arm member (the end opposite the curved arm distal end 42). The rotation is continued until the trapezoidal indents 43—43 matingly engage the trapezoidal detents 44—44 positioned on the interior of housing 21. The angularly indented outer surfaces of the respective trapezoid indent and detent portions bias the brush 25 on the housing 21. If the brush 25 should be rotated slightly relative the housing 21 after the respective trapezoidal portions have engaged, the forces between the respective outer angled surfaces will tend to re-position each angular detent portion centrally in each angular indent portion.

Also, as the detent 33 approaches a fully inserted position in the aforementioned space defined by the surface 26*a* and the bayonet arm member 32, the curved distal end 42 of the elongate arm member engages the axially inwardmost surface of elongate detent 33. In this engagement, the curved distal end is biased against the detent 33 to provide a rattle-free mounting between the brush 25 and housing 21. In order to accommodate the curved distal end 42 of arm member 41 if the brush is rotated oppositely of the preferred rotation, the end of detent 33 which would preferably not engage the curved end 42 includes a beveled surface (not shown). The bevelled surface deflects the arm curved end 42 sufficiently to allow the bayonet arm member to slide over the elongate detent 33 until the trapezoidal indents and detents interlock. The resiliency of the bayonet arm members and the radial thickness of the trapezoidal detents are such that the relative obstruction to rotation therebetween may be overcome by hand twisting the brush relative the housing 25 from either direction of rotation.

To remove the brush from its mounted position on housing 21, a sufficient angular rotation of the brush in either direction relative the housing disconnects the bayonet arm member 32 from the elongate detent portion 33 and disconnects the trapezoidal detent portion 44 from the trapezoidal indent portion 43. When the bayonet arm members are positioned in the spaces between the elongate detents, the brush may be pulled axially outwardly of the housing.

Referring to FIGS. 2 and 8, the second bayonet mounting of the present invention positioned between the inlet end surface 35 of housing 21 and the inlet housing 22 includes a plurality of radially extending bayonet arm members 36—36 oriented in substantially even angular spaced relation around the interior edge of the annular bottom surface 45 on the inlet housing 22. Each bayonet arm member, in this embodiment there are five bayonet arm members and a locking post in the space of the sixth bayonet arm member, includes an axially extending web portion 36*a* and a detent portion 38 which extends radially outwardly of the web portion 36*a* in a position spatially related to the bottom annular surface 45 of the switch housing 22. In this embodiment, the detent portions 38 include generally rectangular surfaces positioned perpendicularly to each other to define a cubical detent extending from the generally flat web 36. It should be noted that the webs 36*a* may be curved somewhat as they are formed integrally with the annular bottom portion of the inlet housing 22. The locking post (not shown) is similar to a detent portion 38 with the exception that it has a cylindrical side surface.

The L-shape indent portions 37—37 on the inner surface of housing 21 are positioned in equal annular spaced relation around the end surface of housing 21 with one end of each in communication with the inlet end surface 35. In this embodiment, there are five such L-shape surfaces and an annular aperture 38*a* (FIG. 1) located in the position which would normally be occupied by a sixth L-shape indent portion. Each L-shape indent portion extends a sufficient depth radially into the annular housing wall to allow the movement of the detent portions 38 of each bayonet arm member 36 therein. Each indent portion includes a stem portion 37*a* which is in communication with the housing inlet end surface 35, and a leg portion 39 which extends perpendicularly from the stem portion in spaced internal relation to the end surface 35. The leg portion 39 includes a retaining surface 39*a* which is positioned parallel to end surface 35 and which is adapted to engage a detent portion 38 in restraining relation when said inlet housing 22 is mounted on said fan and heater housing 21.

In operation, the annular indent housing 22 is axially aligned with the fan and the heater housing 21 adjacent to the inlet end surface 35 thereof such that each bayonet arm member 36 is aligned with the stem portion 37*a* of a respective L-shape indent 37 which is in communication with the annular outer surface 35 of the housing 21. The bottom annular surface 45 of the inlet housing 22 is then moved closer to the annular end surface 35 of the housing 21 until the detent portions 38 of the bayonet arm members 36 are inserted in the stems 37*a* of the L-shape indents 37. The bayonet member 36 having the locking post thereon is deflected radially inwardly so that the post clears the inside surface of the housing 21. Once the respective housing annular end surfaces 35 and 45 are touching, housings 21 and 22 are rotated relative each other in a direction which positions the detent portion 38 of each bayonet arm member 36 against the inner shoulder 39*a* of each L-shape indent 37. When the locking post aligns with aperture 38*a* it snaps into the aperture to lock the two housings together.

In order to remove the housing 22 from housing 21, the locking post must be pushed inwardly of the aperture 38 until it clears the housing inner surface. While the post is held biased inwardly, the housings are rotated relative each other in a direction which is reverse to that utilized to assemble the two together. When the bayonet member detent portions 38 are aligned with the stem portions 73*a* of L-shape indents 37, the two housings may be pulled apart. It should be noted that the second bayonet mounting of the invention is unlike the first bayonet mounting in that only one direction of relative rotation will join the two housings correctly. The sizes of the relative bayonet arm members 36 and the detent portions 38 thereon in comparison with the relative dimensions of each L-shape arm member provide for a secure mounting of housing 22 on housing 21 without any rattling therebetween when joined together.

Further, it should be noted that the multiple actions necessary to separate the two housing partitions 21 and 22 are engineered to be performed by repairmen and not by general consumers. Also, the fixed orientation of the housings provided by the locking post facilitates the correct mounting of other portions of the hair styling appliance in each housing.

While one embodiment of the present invention has been shown and described, it will be obvious to those skilled in the art that changes and modifications may be made without departing from the invention in its broader aspects. Therefore, it is the aim in the appended claims to cover all such changes and modifications as fall within the true spirit and scope of the present invention.

I claim:

1. In a hair styling appliance for applying a hot air stream to hair, said appliance being of the type including a housing having a generally annular air outlet port and a styling attachment including a generally annular air inlet port adapted for releasible mounting on said outlet port;

the improvement comprising:

a plurality of first bayonet mounting members positioned in substantially equally spaced angular relation around one of said annular ports, and a like number of second bayonet mounting members which are matingly engageable with said first members and positioned in substantially equally spaced angular relation around the other of said annular ports;

each of said first bayonet mounting members including an elongate first detent extending radially inwardly of an inner circumference of said one annular port along an arcuate segment thereof, said detent defining a substantially flat elongate first retaining surface positioned in a plane perpendicular to the axis of said port and the distance between the plane of said first retaining surface and the plane of said one port defining the operative thickness of said detent;

each of said second bayonet mounting members including a base portion extending axially outwardly of the plane of the other of said annular ports, a block portion extending radially outwardly from said base portion and defining a second retaining surface generally parallel to the plane of said other port positioned a distance therefrom substantially equal to the thickness of said elongate detent;

said block portion including a resilient arm extending arcuately outwardly thereof, an extension of said second retaining surface on said arm being curved outwardly of the plane of said second retaining surface toward the plane of said other annular port; and the engagement of said first and second bayonet members by rotatingly inserting said elongate detent on said one annular port between said other annular port and said second retaining surface on said block portion biasing said resilient arm against said elongate first detent first retaining surface, whereby a secure rattle-free engagement is accomplished between said housing and said styling attachment.

2. The hair styling appliance as defined in claim 1 wherein said block portion of each said second bayonet mounting member includes an indent positioned on the radially outwardmost surface on said block portion, and wherein a generally tubular inner surface axially inwardly adjacent said one annular port includes a second detent extending radially inwardly of said tubular surface which is adapted to matingly engage said indent in said block portion when said styling appliance is properly mounted on said housing to bias both of same against relative rotation therebetween.

3. The hair styling appliance as defined in claim 2 wherein said indent in said block portion is a wedge shape defining opposed angled substantially flat surfaces, the planes of which intersect within the circumference of said other port; and said second detent defines a complementary wedge shape which is matingly engageable with said indent;

whereby a slight rotating movement of said attachment relative said housing when same are matingly engaged in automatically reversed by a self-centering characteristic of said wedge shape indent and said second detent.

4. The hair styling appliance as defined in claim 1 wherein said one annular port is positioned on said appliance housing and said other annular port is positioned on said styling appliance.

5. The hair styling appliance as defined in claim 1 wherein said one annular port is positioned on said styling appliance and said other annular port is positioned on said housing.

6. The hair styling appliance as defined in claim 3 wherein said wedge shape indent includes a substantially flat surface positioned between said opposed angled surfaces defining a trapezoidal indent; and said wedge shape second detent defines a complementary trapezoidal shape for mating engagement with said indent.

7. The hair styling appliance as defined in claim 1 wherein the arcuate length of said elongate detent approximates the arcuate length of said block portion plus the arcuate length of said resilient arm.

8. The hair styling appliance as defined in claim 1 wherein the end surface of said elongate detent opposite the end thereof which is biased against said resilient arm when said first and second bayonet mounting members are properly engaged includes a bevelled portion which forms a solid obtuse angle with said first retaining surface on said elongate detent for bending said curved arm on said second bayonet member when engaged by same to facilitate the mating engagement of said first and second bayonet mounting members.

9. The hair styling appliance as defined in claim 3 wherein said base portion of said second bayonet member is sufficiently resilient to bendably allow the disengagement of said wedge shape indent with said second detent by the rotation of said styling attachment relative said housing annular port.

10. In a hair styling appliance for applying a hot air stream to hair, said appliance being of the type including first and second housing portions for enclosing functional apparatus inside said appliance, said first housing portion including a first annular port, said second housing portion including a second annular port which is adapted for releasible mating engagement with said annular port;

an improvement comprising:

a plurality of bayonet mounting members positioned in substantially equally spaced angular relation around said first annular port, and a plurality of bayonet receiving indents positioned around said second annular port in substantially equally spaced relation and adapted for mating engagement with said bayonet members;

said bayonet members including a base portion extending axially outwardly of said first annular port and including an outer surface positioned in spaced radial relation inwardly of an outer circumference of said first port, and a detent extending radially outwardly of said base portion outer surface and defining a spatial distance between the plane of said first annular port and a parallel plane of the closest surface thereto on said detent;

said bayonet receiving indents being L-shape and formed in an interior wall of said second housing portion immediately adjacent to said second annular port, said bayonet receiving indent including a step portion extending axially inwardly of said housing port in endwise communication therewith, and a foot portion extending from said step portion substantially arcuately around the interior of said second housing portion inwardly adjacent said second annular port, said foot portion defining a retaining surface positioned substantially parallel to the face of said second annular port a distance therefrom substantially equal to said spatial distance, the engagement of said bayonet mounting members in said bayonet receiving indents by aligning said detents with said indent stem portions, inserting same therein until said first and second annular ports touch, and rotating said first housing portion relative said second housing portion engaging said detent with said indent retaining surface.

11. The hair styling appliance as defined in claim 10 wherein the number of bayonet mounting members is greater than the number of said L-shape indents, and said second housing further includes:

an additional bayonet receiving indent positioned in equally spaced relation around said second housing with said L-shape indents, said additional indent being an aperture shaped similarly to one of said bayonet mounting members for locking mating engagement therewith; and the engagement being accomplished by biasing the base portion of said additional bayonet member inwardly of said second housing as the other bayonet members are inserted in said L-shape indents.

12. The hair styling appliance as defined in claim 10 further including an additional bayonet member positioned in substantially equally spaced angular relation with said plurality thereof, said additional bayonet member including a detent which is shaped differently from the detents on said other bayonet members;

an additional bayonet receiving indent being an aperture in said second housing which is shaped similarly to said first detent for mating engagement therewith, and the engagement being accomplished by biasing the base portion of said additional bayonet member inwardly of said second housing as the other bayonet members are inserted in said L-shape indents.

* * * * *